US011298839B2

(12) United States Patent
Fuerst et al.

(10) Patent No.: US 11,298,839 B2
(45) Date of Patent: Apr. 12, 2022

(54) HAIR REMOVAL DEVICE

(71) Applicant: Braun GmbH, Kronberg (DE)

(72) Inventors: Stefan Fuerst, Kronberg (DE); Reinhold Eichhorn, Idstein (DE); Martin Fuellgrabe, Bad Camberg (DE)

(73) Assignee: Braun GMBH, Kronberg (DE)

( * ) Notice: Subject to any disclaimer, the term of this patent is extended or adjusted under 35 U.S.C. 154(b) by 0 days.

(21) Appl. No.: 16/364,753

(22) Filed: Mar. 26, 2019

(65) Prior Publication Data

US 2019/0299432 A1 Oct. 3, 2019

(30) Foreign Application Priority Data

Mar. 27, 2018 (EP) ..... 18164337

(51) Int. Cl.
*B26B 19/04* (2006.01)
*B26B 19/06* (2006.01)
(Continued)

(52) U.S. Cl.
CPC ..... *B26B 19/048* (2013.01); *B26B 19/063* (2013.01); *B26B 19/10* (2013.01);
(Continued)

(58) Field of Classification Search
CPC ... B26B 19/046; B26B 19/048; B26B 19/386; B26B 19/063; B26B 19/10;
(Continued)

(56) References Cited

U.S. PATENT DOCUMENTS 4,531,287 A 7/1985 Shibata et al.
4,930,217 A * 6/1990 Wolf ..... B26B 19/048 30/43.92
(Continued)

FOREIGN PATENT DOCUMENTS

CN 1018016 A 12/1990
CN 1688420 A 10/2005
(Continued)

OTHER PUBLICATIONS

European search report dated Jul. 18, 2018.
(Continued)

*Primary Examiner* — Ghassem Alie
*Assistant Examiner* — Samuel A Davies
(74) *Attorney, Agent, or Firm* — Gerd Zetterer; Kevin C. Johnson

(57) ABSTRACT

A hair removal device comprising a working head attached to a handle for moving the working head along a skin surface is provided. The working head includes at least one hair removal tool defining a skin contact contour of the working head, wherein the at least one hair removal tool is movable relative to the handle under a skin contact pressure by a support structure to allow for pivoting of the working head's skin contact contour relative to the handle. The support structure movably supporting the hair removal tool relative to the handle is configured to allow for pivoting of the skin contact contour relative to the handle about an angle of about +/−15° or more under a contact force of about 0.75 N or less and/or about an angle of about +/−20° or more under a contact force of about 1.5 N or less.

15 Claims, 5 Drawing Sheets

(51) Int. Cl.
*B26B 19/10* (2006.01)
*B26B 19/38* (2006.01)
*A45D 26/00* (2006.01)

(52) U.S. Cl.
CPC ..... *B26B 19/388* (2013.01); *B26B 19/3853* (2013.01); *A45D 2026/0095* (2013.01)

(58) Field of Classification Search
CPC . B26B 19/385; B26B 19/388; B26B 19/3853; A45D 2026/0095
See application file for complete search history.

(56) References Cited

U.S. PATENT DOCUMENTS 5,007,168 A * 4/1991 Messinger ..... B26B 19/14 30/41.5
5,189,792 A * 3/1993 Otsuka ..... B26B 19/046 30/41.6
5,257,456 A * 11/1993 Franke ..... B26B 19/048 30/43.1
5,687,481 A * 11/1997 De Boer ..... B26B 19/145 30/43.6
5,745,995 A * 5/1998 Yamashita ..... B26B 19/048 30/43.6
6,568,083 B1 * 5/2003 Taniguchi ..... B26B 19/048 30/43.1
6,826,835 B1 * 12/2004 Wong ..... B26B 19/42 30/34.2
7,350,300 B2 * 4/2008 Yamaguchi ..... B26B 19/38 30/43.92
7,364,052 B2 4/2008 Spatafora
7,832,104 B2 11/2010 Yamasaki et al.
8,533,960 B1 9/2013 Barish
8,667,692 B2 3/2014 Kraus
8,938,885 B2 * 1/2015 Stevens ..... B26B 21/225 30/527
10,179,418 B2 1/2019 Hendriks et al.
10,576,647 B2 3/2020 Uit De Bulten et al.
2001/0025421 A1 10/2001 Damstra
2002/0088121 A1 7/2002 Jacobsen
2004/0098862 A1 5/2004 Orloff
2004/0231160 A1 * 11/2004 Shiba ..... B26B 19/048 30/43.92
2005/0216035 A1 9/2005 Kraus et al.
2007/0124936 A1 6/2007 Okabe
2007/0277379 A1 12/2007 Okabe
2008/0034591 A1 2/2008 Fung
2008/0196258 A1 8/2008 Kraus
2009/0000126 A1 * 1/2009 Kraus ..... B26B 19/046 30/34.1
2009/0056141 A1 3/2009 Barry et al.
2009/0119923 A1 5/2009 Hart et al.
2010/0186234 A1 7/2010 Binder
2011/0094102 A1 4/2011 Ring et al.
2011/0094107 A1 4/2011 Ring et al.
2011/0197726 A1 8/2011 Kraus
2013/0025078 A1 1/2013 Heil et al.
2013/0097873 A1 4/2013 Luo et al.
2014/0207811 A1 7/2014 Kim et al.
2015/0020658 A1 1/2015 Hasam
2015/0032128 A1 1/2015 Tavlin et al.
2015/0197016 A1 7/2015 Krenik
2016/0001455 A1 * 1/2016 Swenson ..... B26B 21/521 30/57
2016/0167241 A1 6/2016 Goldfarb et al.
2016/0199987 A1 7/2016 Brada et al.
2017/0097758 A1 4/2017 Bauer et al.
2017/0099199 A1 4/2017 Bauer et al.
2017/0172278 A1 6/2017 Mehaddene et al.
2017/0291319 A1 10/2017 Hendriks et al.
2017/0325566 A1 11/2017 Franklin et al.
2017/0340085 A1 11/2017 Kindermann
2018/0000219 A1 1/2018 Roenneberg et al.
2018/0236675 A1 8/2018 Westerhof et al.
2018/0243929 A1 8/2018 Takechi et al.
2018/0293511 A1 10/2018 Bouillet et al.
2019/0015998 A1 1/2019 Neyer et al.
2019/0061183 A1 2/2019 Neyer et al.
2019/0090999 A1 3/2019 Vetter et al.
2019/0126500 A1 5/2019 Wu
2019/0224869 A1 7/2019 Robinson et al.
2019/0299434 A1 10/2019 Fuerst et al.
2019/0299435 A1 10/2019 Fuellgrabe et al.
2019/0299436 A1 10/2019 Fuellgrabe et al.
2019/0299437 A1 10/2019 Fuellgrabe et al.
2019/0306259 A1 10/2019 Burghardt et al.
2020/0156272 A1 5/2020 De Vries et al.

FOREIGN PATENT DOCUMENTS

CN 101621400 A 1/2010
CN 202106393 U 1/2012
CN 203197960 U 9/2013
CN 104185537 A 12/2014
CN 204431302 U 7/2015
CN 105835093 A 8/2016
CN 105899336 A 8/2016
CN 106407935 A 2/2017
CN 106621280 A 5/2017
CN 106778618 A 5/2017
CN 107073727 A 8/2017
CN 107107351 A 8/2017
CN 107243905 A 10/2017
CN 107414902 A 12/2017
CN 107627329 A 1/2018
CN 107682178 A 2/2018
CN 107718059 A 2/2018
CN 110303526 A 10/2019
CN 110303527 A 10/2019
CN 110303531 A 10/2019
CN 110303532 A 10/2019
CN 110303533 A 10/2019
DE 10246519 A1 4/2004
DE 102005045713 A1 3/2007
DE 102006004675 A1 8/2007
DE 102008031132 A1 1/2010
DE 102010023681 A1 12/2011
EP 720523 B1 8/1998
EP 1165294 A1 1/2002
EP 1854593 B1 6/2010
EP 1549468 B1 11/2011
EP 3197649 B1 5/2018
EP 3546149 A1 10/2019
EP 3546150 A1 10/2019
EP 3546151 A1 10/2019
EP 3546152 A1 10/2019
EP 3546153 A1 10/2019
JP S5737472 A 3/1982
JP S5877445 A 5/1983
JP S59184778 U 12/1984
JP 04195302 A 7/1992
JP H06086873 U 3/1994
JP H6335575 A 12/1994
JP 08152902 A 6/1996
JP H08187376 A 7/1996
JP H9101804 A 4/1997
JP 2000507139 A 6/2000
JP 2000508570 A 7/2000
JP 2003009937 A 1/2003
JP 2004130153 A 4/2004
JP 2006501911 A 1/2006
JP 2006255335 A 9/2006
JP 2008501911 A 1/2008
JP 2008043426 A 2/2008
JP 2008307132 A 12/2008
JP 2009508606 A 3/2009
JP 2009525090 A 7/2009
JP 2010227223 A 10/2010
JP 2010227224 A 10/2010
JP 2011526168 A 10/2011
JP 2012527939 A 11/2012
JP 2016077464 A 5/2016

(56) References Cited

FOREIGN PATENT DOCUMENTS

| | | | | |
|---|---|---|---|---|
| JP | 2016534805 | A | 11/2016 | |
| JP | 2017526492 | A | 9/2017 | |
| JP | 2016-077464 | * | 10/2017 | |
| JP | 2016077464 | * | 10/2017 | ..... B26B 19/38 |
| JP | 2017529168 | A | 10/2017 | |
| JP | 2017536948 | A | 12/2017 | |
| JP | 2018503420 | A | 2/2018 | |
| JP | 2018532481 | A | 11/2018 | |
| JP | 2019171033 | A | 10/2019 | |
| JP | 2019171048 | A | 10/2019 | |
| JP | 2019171049 | A | 10/2019 | |
| JP | 2019171051 | A | 10/2019 | |
| JP | 2019171060 | A | 10/2019 | |
| WO | 2001013757 | A1 | 3/2001 | |
| WO | 2007033729 | A1 | 3/2007 | |
| WO | 2014091719 | A1 | 6/2014 | |
| WO | 2015067498 | A1 | 5/2015 | |
| WO | 2016094327 | A1 | 6/2016 | |
| WO | 2016096581 | A1 | 6/2016 | |
| WO | 2017032547 | A1 | 3/2017 | |
| WO | 2017062326 | A1 | 4/2017 | |
| WO | 2018002755 | A1 | 1/2018 | |

OTHER PUBLICATIONS

Search Report by Industrial Property Cooperation Center; Japanese Application No. 2019-052815; Jul. 7, 2020; Japan Patent Office; Tokyo, Japan.

Chakravorty, Tanushri Article Dated Oct. 28, 2016; "How Machine Learning Works; An Overview;" obtained from https://thenewstack.io/how-machine-learning-works-an-overview; accessed Oct. 5, 2020.

Smuts, Jacques Article Dated Nov. 29, 2016; "Tutorial on Filters in Control Systems;" obtained from https://blog.opticontrols.com/archives/1319; accessed Oct. 5, 2020.

Boukhalfa, Sofiane Article Dated May 2017; "IoT and AI Combine to Dominate Consumer Electronics;" obtained from https://www.prescouter.com/2017/05/iot-ai-consumer-electronics/: accessed Oct. 5, 2020.

European Opinion and Search Report dated Dec. 14, 2018; EP Application No. 18164344; European Patent Office; Munich, Germany.

European Opinion and Search Report dated Jul. 11, 2018; EP Application No. 18164341; European Patent Office; Munich, Germany.

European Opinion and Search Report dated Jul. 16, 2018; EP Application No. 18164369; European Patent Office; Munich, Germany.

European Opinion and Search Report dated Jul. 18, 2018; EP Application No. 18164335; European Patent Office; Munich, Germany.

European Opinion and Search Report dated Jul. 9, 2018; EP Application No. 18164343; European Patent Office; Munich, Germany.

Japan Search Report dated Apr. 22, 2020; Japan Application No. 2019047272; Japan Patent Office; Tokyo, Japan.

Japan Search Report dated Apr. 23, 2020; Japan Application No. 2019044483; Japan Patent Office; Tokyo, Japan.

Japan Search Report dated Jul. 20, 2020; Japan Application No. 2019052815; Japan Patent Office; Tokyo, Japan.

Japan Search Report dated Jun. 26, 2020; Japan Application No. 2019052818; Japan Patent Office; Tokyo, Japan.

Japan Search Report dated Jun. 26, 2020; Japan Application No. 2019053167; Japan Patent Office; Tokyo, Japan.

Bermudez-Chacon, Roger et al article dated 2015; "Automatic problem-specific hyperparameter optimization and model selection for supervised machine learning: Technical Report;" obtained from https://www.research-collection.ethz.ch/bitstream/handle/20.500.11850/107673/eth-48308-01.pdf; accessed Oct. 5, 2020.

Davies, Samuel Allen Restriction/Election Requirement dated Jun. 19, 2020; U.S. Appl. No. 16/364,713; U.S. Patent and Trademark Office; Alexandria, Virginia.

Patel, Bharat C. Restriction/Election Requirement dated May 27, 2020; U.S. Appl. No. 16/364,739; U.S. Patent and Trademark Office; Alexandria, Virginia.

China First Search dated Aug. 31, 2020; Chinese Application No. 2019102249740; Chinese National Intellectual Property Administration; Beijing, China.

China First Search dated Jun. 20, 2020; Chinese Application No. 201902309169; Chinese National Intellectual Property Administration; Beijing, China.

China First Search dated Aug. 7, 2020; Chinese Application No. 2019102349429; Chinese National Intellectual Property Administration; Beijing, China.

China First Search dated Aug. 17, 2020; Chinese Application No. 2019102349433; Chinese National Intellectual Property Administration; Beijing, China.

China First Search dated Aug. 26, 2020; Chinese Application No. 2019102349467; Chinese National Intellectual Property Administration; Beijing, China.

China First Search dated Jun. 18, 2020; Chinese Application No. 2019102297388; Chinese National Intellectual Property Administration; Beijing, China.

Lewis et al., Reinforcement Learning and Optimal Adaptive Control, Oct. 2011, Chapter 11, pp. 461-517 (Year: 2011).

* cited by examiner

HAIR REMOVAL DEVICE

FIELD OF THE INVENTION

The present invention relates to a hair removal device, in particular electric shaver, comprising a working head attached to a handle for moving the working head along a skin surface, said working head including at least one hair removal tool defining a skin contact contour of the working head, wherein said at least one hair removal tool is movable relative to said handle under a skin contact pressure by means of a support structure to allow for pivoting of the working head's skin contact contour relative to the handle.

BACKGROUND OF THE INVENTION

Hair removal devices such as an electric shaver, epilators, or beard trimmers usually include different types of hair removal tools so as to allow for removing long hairs as well as medium hairs and short hairs and stubbles, as commonly found in men's beards and women's legs. Short hair cutters may include a movable cutting blade or undercutter which cooperates with a thin, flexible mesh screen or apertured or perforated foil, wherein such mesh screen or foil may have a rounded, elongated contour and the undercutter may reciprocate under such elongated, rounded contour of the mesh screen along a longitudinal axis thereof. Other types of short hair cutters use rotatory cutter elements which may be driven in an oscillating or a continuous manner and may cooperate with disc-shaped mesh screens covering said rotatory cutter elements. By means of slidingly guiding the mesh screen or perforated foil over the skin surface to be shaved, the individual hair shafts enter the holes formed in the screen or foil and are cut by the movement of the cutting blades.

For medium and/or longer hair fibers, separate hair trimmers may be provided at the working head, wherein such trimmers may be positioned adjacent to one of the short hair cutters. For example, such trimmers may form an elongated block extending along one of the elongated, rounded mesh screens or perforated foils of the short cutters. Such trimmers may include a cutter bar with a pair of sickle finger bars reciprocating relative to each other, but may also include a foil or cover plate having comparatively larger apertures under which an undercutter with cutting blades may reciprocate or continuously rotate to cut hairs entering the apertures.

To achieve good hair removal performance, said short hair cutters, long hair cutters and other hair removal tools should be positioned substantially perpendicular onto the skin to be treated, what is sometimes difficult due to uneven skin contours and skin surface orientations requiring a user's hand to twist unnaturally to hold the device's handle in a position in which the hair removal tool is indeed perpendicular onto the surface.

So as to compensate for holding the handle in wrong orientations, it is known to have the hair removal tool movably supported relative to the handle under a skin contact pressure by means of a support structure to allow for pivoting of the working head's skin contact contour relative to the handle so that the skin contact contour of the working head may adapt to the skin surface orientation. Such pivotable self-adaption of the hair removal tool's orientation may be achieved in different ways including multi-axial movability of the hair removal tool. For example, some support structures allow for single-axial or multi-axial pivoting of the entire working head frame relative to the handle, and in addition to pivoting of the working head frame, diving/floating and/or pivoting of the short hair cutter and/or trimmer tools relative to the working head frame. When there are more than one hair removal tools such as, e.g., a pair of short hair cutters and a long hair cutter, diving of the short hair cutters into the working head frame in a direction substantially perpendicular to the skin contact contour or along a substantially circular path may also achieve pivoting of the skin contact contour when, e.g., one of the hair removal tools is diving and the other is not under asymmetric skin contact pressure onto the plurality of hair removal tools.

With such self-adjusting working heads and hair removal tools it is nevertheless a problem to achieve a sufficient self-adaption to the skin contour and skin surface orientation on the one hand and, at the same time, give the user the feeling of control when increasing the skin contact pressure to achieve a thorough hair removal at a particular area. One reason for insufficient self-adaption is the fact that some users wish to have a mild treatment and press the working head only gently onto the skin. On the other hand, there are some users applying a rather high contact pressure to achieve thorough hair removal, e.g., at the upper lip region below the nose, what is detrimentally affected by too much self-adaption by the working head's skin contact contour.

For example, document EP 18 54 593 B1 describes an electric shaver having a working head with a set of short and long hair cutters which may pivot relative to the handle to achieve self-adaption to the skin contour and the skin surface orientation. In order to avoid undesired pivoting due to the working head's weight, e.g. when the shaver is not held in an upright, but in a substantially horizontal position in which the shaver head's weight creates a torque due to its lever arm relative to the pivot axis, it is suggested to apply a counterbalancing weight to compensate for the tendency to undesired pivoting. More particularly, a weight applying member is coupled to the pivotable working head structure to extend to a side of the pivot axis opposite to the main portion of the working head. Such counterbalancing weight, however, significantly increases the inertia of the working head structure and thus reduces the agility of the hand-held device.

SUMMARY OF THE INVENTION

It is an objective underlying the present invention to provide for an improved hair removal device avoiding at least one of the disadvantages of the prior art and/or further developing the existing solutions. A more particular objective underlying the invention is to provide for an improved working head structure of such hair removal device with improved self-adaption to varying skin contours and skin surface orientations. Another objective underlying the invention is to allow for easy self-adaption of the hair removal tools to complex skin contours over a wide range of angular movements together with a gently treatment of the skin, but still providing for a good feeling of control when pressing the working head against a skin portion to achieve thorough hair removal.

At least one of the above objectives is achieved by a hair removal device with the features of claim 1. At least one of the above objectives is also achieved by a hair removal device with the features of claim 6. At least one of the above objectives is also achieved by a hair removal device with the features of claim 15. Advantageous embodiments are provided by the features of the sub-claims.

To achieve at least one of the aforementioned objectives, the hair removal device has an improved working head structure allowing for pivoting movements of the working head's skin contact contour over a predetermined angular range even when the working head is carefully slid along the skin to achieve a gentle treatment thereof. More particularly, the skin contact contour of the working head is allowed to pivot about a pivot axis over a rather large angular range under small contact forces. According to an aspect the support structure movably supporting the hair removal tool relative to the handle is are configured to allow for pivoting of the skin contact contour relative to the handle about an angle of +/−15° or more under a contact force of 0.75 N or less and/or about an angle of +/−20° or more under a contact force of 1.5 N or less. Such configuration of the support structure allows for a wide range of self-adaption during gentle treatment of the skin with slight contact forces.

More particularly, said support structure may be configured to allow for pivoting of the skin contact contour relative to the handle about an angle of +/−22.5° or more under a contact force of 0.75 N or less and about an angle of +/−30° or more under a contact force of 1.25 N or less.

The pivoting resistance, i.e. the force and/or torque applied to the working head and/or the hair removal tool necessary to achieve pivoting of the skin contact contour and/or necessary to achieve a certain angular displacement of the skin contact contour, may, to some extent, result from frictional resistance of the support structure and/or for example the frictional resistance from the coupling of the drive structure between the hair removal tool and the motor location and/or may be controlled by a pivot resistance controller which may form part of the support structure.

The support structure may include a biasing device for biasing the hair removal tool into a changed position and/or into a (predefined) neutral position in the absence of skin contact pressure, wherein such biasing device, for example, may include a spring device trying to urge the hair removal tool towards their neutral position. Such neutral position may be an intermediate position from which the skin contact contour may pivot towards opposite angular positions in terms of, for example, clockwise and anticlockwise pivoting. In addition to or in the alternative to such biasing means or the support structure may include a braking device for providing a braking force and/or braking torque that needs to be overcome when changing the angular position of the skin contact contour and/or pivoting said skin contact contour. In addition or in the alternative, such biasing means or the support structure may include a damper or braking device providing for pivoting resistance/torque to the working head. The pivot resistance controller may optionally be switched on and/off (including an automatic switch on/off)

When there is a biasing device as mentioned above, the pretentioning provided by such biasing device needs to be overcome to achieve a certain pivot position. As mentioned, the biasing device may be configured to provide for a rather small pivoting resistance only to allow for easy self-adaption during gentle treatment of the skin with slight contact forces. Nevertheless, the biasing device is powerful enough to bias the hair removal tool into a neutral position in the absence of skin contact pressure irrespective of the hair removal device and its handle being held in an upright or horizontal position.

According to a further aspect, the support structure is adjustable in terms of pivoting resistance and the angular displacement range over which the skin contact contour of the working head may pivot. More particularly, a pivot range adjustment device is provided for adjusting the maximum pivot angle about which the skin contact contour is pivotable relative to the handle to have at least a first setting in which said angle is less than +/−35° and more than +/−5° and a second setting in which said angle is less than +/−25° and more than +/−5° with said second setting being different from the first setting.

Said pivot range adjustment device may be coupled to the pivot resistance controller and configured to increase the pivoting resistance when reducing the angular range over which the skin contact contour may pivot. In other words, when reducing the pivot range the stiffness of the working head and hair removal tool are increased to provide for a better feeling of control.

These and other advantages become more apparent from the following description giving reference to the drawings and possible examples.

DETAILED DESCRIPTION OF THE INVENTION

Figure 1:
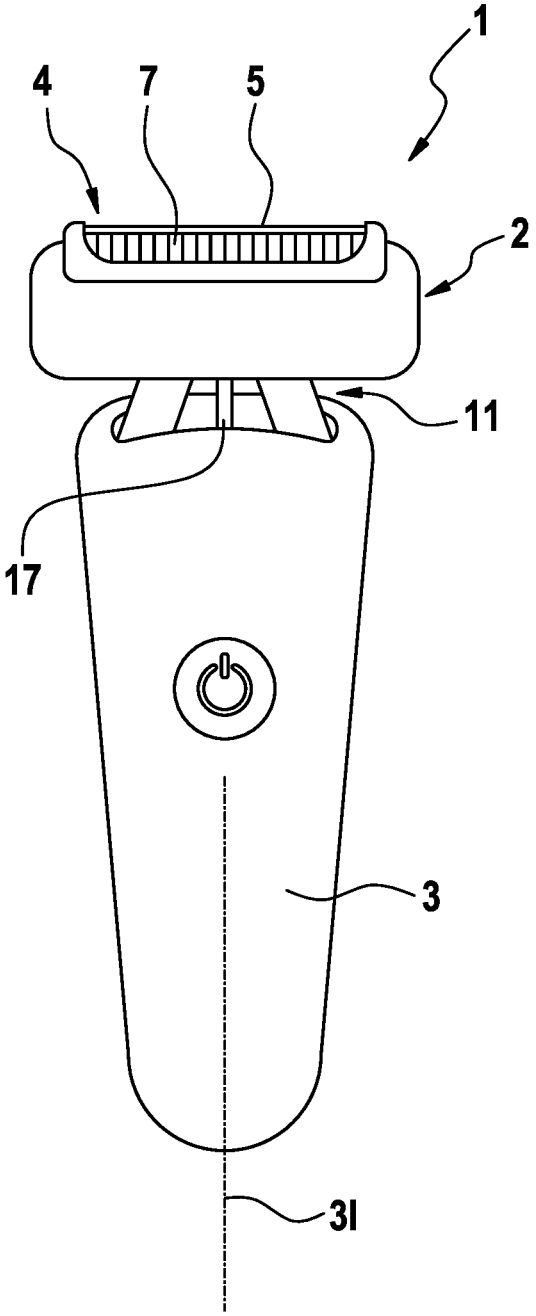
FIG. 1 is a front view of a hair removal device in terms of an electric shaver comprising a handle and a working head attached thereto, said working head including a set of hair cutting tools.

To achieve better adaption to the skin contour and compensation of "wrong" orientation of the handle, the hair removal device has an improved working head structure allowing for pivoting movements of the working head's skin contact contour over a wide angular range even when the working head is carefully slid along the skin to achieve a gentle treatment thereof. More particularly, the skin contact contour of the working head is allowed to pivot over a rather large range under small contact forces. According to an aspect the support structure movably supporting the hair removal tool relative to the handle and the biasing device biasing the hair removal tool into a changed position which may be but don't need to be a neutral position in the absence of skin contact pressure, is configured to allow for pivoting of the skin contact contour relative to the handle about an angle of +/−15° or more under a contact force of 0.75 N or less and/or about an angle of +/−25° or more under a contact force of 1.5 N or less. Such configuration of the support structure and biasing device allow for a wide range of self-adaption during gentle treatment of the skin with slight contact forces. Nevertheless, the biasing device is powerful enough to bias the hair removal tool into a changed position irrespective of the hair removal device and its handle being held in an upright or horizontal position. More particularly, said biasing device and support structure may be configured to allow for pivoting of the skin contact contour relative to the handle about an angle of +/−22.5° or more under a contact force of 0.75 N or less and about an angle of +/−30° or more under a contact force of 1.25 N or less.

According to a further aspect, the biasing device and the support structure are adjustable in terms of pivoting resistance and the angular range over which the skin contact contour of the working head may pivot. More particularly, a pivot range adjustment device is provided for adjusting the pivot angle about which the skin contact contour is pivotable relative to the handle to have at least a first setting in which said angle is less than +/−35° and more than +/−5° and a second setting in which said angle is less than +/−25° and more than 5° with said second setting being different from the first setting.

The kinematics of the support structure may have different configurations. For example, there may be only one pivot axis about which the entire working head may pivot relative to the handle. In the alternative, the support structure may allow for multi-axial pivoting, wherein e.g. a swivel axis and a tilt axis (for the case of a two axial pivoting) extending substantially perpendicular to each other and parallel to an enveloping plane to the working head's skin contact contour when considering the working head in a neutral position. In addition or in the alternative, the at least one hair removal tool may pivot and dive or float relative to a working head frame.

More particularly, different levels of pivoting may be available to the at least one hair removal tool.

According to a further aspect, the at least one hair removal tool or part of a hair removal tool is movably supported relative to a working head frame, and said working head frame may be pivotably supported relative to the handle to allow for pivoting of the skin contact contour relative to the handle, wherein the support structure and the biasing device are configured to allow for pivoting of the working head frame about a pivot axis relative to the handle about an angle $\alpha$1 of +/−20° or more under a contact force F1 and to allow for pivoting of the skin contact contour about a pivot axis parallel to the aforementioned pivot axis by means of moving the hair removal tool relative to the working head frame about an angle $\alpha$2 of +/−2° or +/−5° or more under a contact force F2, wherein said contact force F1 pivoting the working head frame may be smaller than said contact force F2 moving the hair removal tool relative to the working head frame or moving part(s) of the head frame relative to the handle or relative to other parts(s) of the head frame. In addition or in the alternative, part(s) of the working head frame may move relative to the handle and/or other part(s) of the working head frame.

More particularly, said contact force F1 pivoting the working head frame may be 0.5 N or less and said contact force F2 moving the hair removal tool relative to the working head frame may be 1.5 Nor less.

According to a further aspect, a pivot range adjustment device may be provided for adjusting the pivot angle $\alpha$ about which the skin contact contour is pivotable relative to the handle, to have a first setting which is different from a second setting. Preferably this difference in angle between both settings deviates from about 0° or more preferably from about 3°. Preferably in the first setting in which said angle $\alpha$ is less than +/−35° and more than +/−5° and a second setting in which said angle $\alpha$ is less than +/−25° and more than +/−5° with said second setting different from said first setting.

In prior art shavers, it is known to lock the shaver head so it may no longer pivot relative to the handle. This is also possible for the working head of the present hair removal device. However, in addition to such locking, the aforementioned pivot range adjustment means that the maximum pivot angle can be set to have different values each of which are different from 0. In other words, the maximum pivot angle may be set to assume a large value and to have a smaller value still larger than 0.

According to a further aspect, in said first setting the angle $\alpha$ is less than +/−30° and more than +/−20° and in said second setting the angle $\alpha$ is less than +/−20° and more than +/−5°. The pivot range adjustment device may be configured to allow for a continuous adjustment of the maximum pivot angle over a certain range. For example, when the maximum pivot angle may be adjusted over a range from +/−5° to +/−20°, continuous adjustment means that any value between −5° and +20° can be set for the maximum allowed pivot angle. Such continuous adjustment allows for fine adaption to the user's needs.

In addition or in the alternative, the pivot range adjustment device may be configured to allow for a stepwise adjustment of the maximum pivot angle, wherein such stepwise adjustment may include at least three steps from, e.g., +/−5° to +/−10° to +/−20°. Such stepwise adjustment allows for a quicker setting and leads to quicker recognition of a variation of the pivot range.

According to another aspect, the pivot resistance controller may be adjustable in terms of force and/or torque applied to the working head frame and/or hair removal tool resistance that needs to be overcome to urge the skin contact contour of the working head into a certain pivot position. Such resistance that needs to be overcome adjustment device allows for variation of the resistance against pivoting and/or floating of the hair removal tool and thus, allows for adjustment of the responsiveness and control feeling. More particularly, when the resistance force and/or torque is increased, the working head provides for a more aggressive, more agile handling which is usually appreciated when thoroughly treating certain skin portions such as the upper lip below the nose. On the other hand, when resisting forces and/or torque is reduced, the working head's skin contact contour may pivot more easily, i.e. with less resistance to allow for a more gentle treatment.

The adjustment of the pivot resistance controller such as the biasing device may be coupled to the adjustment of the pivot range to achieve adjustment of the pivoting stiffness and/or floating stiffness as well as adjustment of the pivot range at the same time. More particularly, the aforementioned pivot range adjustment device may be coupled to the biasing device and/or to the pivot resistance adjustment device so that actuation of only one adjustment device provides for adjustment of pivot resistance forces and/or torque and the angular pivot range.

According to an aspect, the pivot range adjustment may be coupled to the resistance adjustment such that resistance force and/or torque is increased when the angular pivot range is decreased. On the other hand, when the angular pivot range is increased, i.e. the maximum available pivot angle is increased, the resistance force and/or torque is reduced to allow for easy pivoting over a wide range.

The aforementioned pivot range adjustment device and/or biasing adjustment device may be provided with a manual actuator so that the pivot range and/or biasing may be adjusted manually. For example, a sliding knob or a rotatable adjustment element may be provided to allow for adjusting of the pivot range and/or biasing force/torque.

In addition or in the alternative, there may be an adjustment actuator such as an electric motor, a magnetic element or a fluid pressure cylinder to allow for automatic or semi-automatic actuation of the pivot range adjustment device and/or biasing adjustment device. For example, such adjustment actuator may be controlled by an electronic control unit in response to one or more treatment parameters detected by a corresponding detector when handling the hair removal device during a hair removal session. For example, the hair removal device may be provided with a skin pressure sensor for detecting skin contact pressure of the working head and/or of the hair removal tool, wherein the electronic control unit may cause the adjustment actuator to vary the pivot range and/or the biasing in response to a signal of such skin contact sensor indicative of the skin contact pressure. More particularly, when the skin contact sensor detects the working head is pressed harder against the skin surface, the adjustment actuator may become active to increase the biasing force and/or biasing torque and/or decrease the pivot adjustment range to a smaller maximum pivot angle.

According to one aspect, a switch is provided for turning on and off of the biasing adjusting device (26) and/or the pivot resistance controller or alternatively this may occur automatically, for example when the skin contact force is below a certain threshold.

According to another aspect a hair removal device is provided with said support structure and/or said biasing device are configured to allow for pivoting of the skin contact contour relative to the handle about different angle ranges dependent form the contact force and/or skin contact pressure with which the skin contact contour is applied onto the skin. A user pressing harder than usual of the working tool against the skin is interpreted to e.g. wish less shaver head movability over a smaller angular pivotal range and/or less easy movability in order to provide more head control of the head pivotal position despite the higher pressing force and vice versa.

These and other features become more apparent from the examples shown in the drawings. As can be seen from FIG. 1, the hair removal device may be configured as an electric shaver 1 comprising a shaver housing forming a handle 3, wherein in the interior of the handle 3 a drive unit including an electric motor and an electronic control unit may be accommodated. Such handle 3 may have an elongated, substantially bone-shaped configuration extending along a longitudinal axis 31.

At one end of said handle 3, a working head may be mounted to said handle 3, wherein the working head 2 may be movably supported at said handle 3. For example, the support structure 11 supporting the working head 2 at the handle 3 may allow for one-axial or multi-axial pivot (including e.g. two axis or an undefined/unlimited number of axis) and/or swiveling movements of the entire working head 2 relative to the handle 3.

In addition to such basic movability, the working head 3 may allow for a sort of internal movements. More particularly, the working head 2 includes a plurality of hair removal tools 4 which may include a pair of short hair cutters 5 and 6 and a trimmer 7 which are supported movably relative to a working head base structure. Also the working head may include wings with each wing comprising at least one hair cutting unit which may move relative to the other wing.

More particularly, the working head 3 may include a support frame or working head frame 12 which may be pivotably supported at the handle 3 about a pivot axis 8 to allow for pivoting movements of the support frame 12 and thus, of the working head 2 as a whole relative to the handle 3. In the alternative case for which the working head includes wings, the working head as a whole may be moveable relative to the handle but also the wings individually may be movable to the handle and also relative to each other. Further each hair cutter may be movable as well relative to each other and relative to the handle and the wing in which the at least one hair cutter is provided. The working head frame may be split in two portions which are moveable against each other in case the working head includes a two wing arrangement. Each wing may include one or more hair cutting units.

Said pivot axis 8 may extend parallel to a first plane separating the short hair cutters 4 and 5 from each other and parallel to a second plane extending substantially perpendicular to the aforementioned longitudinal axis 31 of handle 3.

Figure 5:
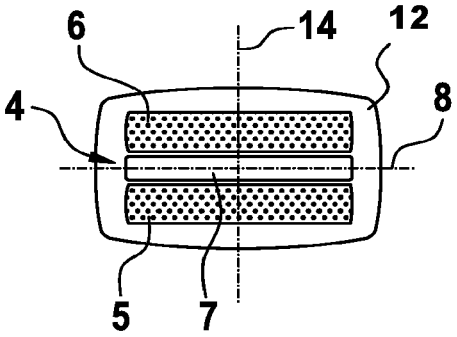
FIG. 5 is a top view of the working head of FIGS. 2 to 4, wherein swivel and tilt axes allowing for multi-axial pivoting are shown.

As can be seen from FIG. 5, the aforementioned short hair cutters 5 and 6 and the aforementioned trimmer 7 may have an elongated, substantially block-like shape and/or an elongated, substantially rectangular shape, wherein the short hair cutters 5 and 6 may include a flexible mesh screen with a curved surface under which an undercutter and/or cutter blade block may reciprocate. On the other hand, the trimmer 7 may include a pair of sickle finger bars reciprocating relative to each other and/or an apertured foil with relatively large apertures under which an undercutter with cutting blades may reciprocate.

Due to the aforementioned elongated shape of the short hair cutters and trimmers the skin contact surface of the working head 2 formed by the top surfaces of the aforementioned short hair cutters 5 and 6 and trimmer 7 may have a strip-like configuration and as a whole, may have a rectangular configuration when viewed from the top. For a rotary cutting system the skin contact surface may comprise circular or ring or disc shaped portions for each rotary cutting unit provided which all sum up in a e.g. convex or concave or flat skin contact contour depending from the skin contact contour of the users skin.

Figure 2:
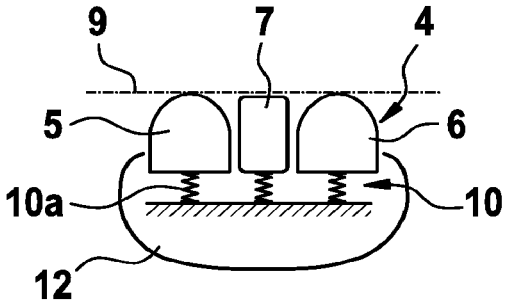
FIG. 2 is a side view of the working head of the electric shaver of FIG. 1 with the hair removal tools being in a neutral position.
Figure 3:
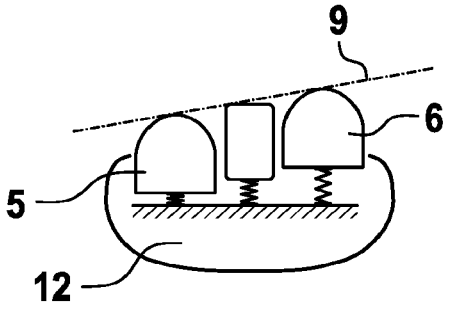
FIG. 3 is a side view of the working head similar to FIG. 2, wherein the hair removal tools are shown in a diving position under asymmetric contact pressure, thereby providing for a pivoting of the skin contact contour of the working head.
Figure 4:
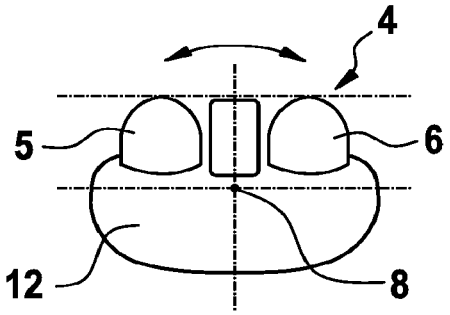
FIG. 4 is a side view of the working head similar to FIGS. 2 and 3, wherein pivoting of the working head frame about a pivot axis is illustrated.

As can be seen from FIG. 3, said hair removal tools 4 in terms of the short hair cutters 5 and 6 and the trimmer 7 may float relative to the working head frame 12 and thus, dive into the working head tool substantially along a direction perpendicular to the skin contact contour 9 or along a substantially circular path, at least when considering such skin contact contour 9 in a neutral or initial position as shown by FIG. 2. Since each hair removal tool 4 may float or dive individually, the skin contact contour 9 may pivot when one of the hair removal tools 4 dives and another one does not dive. In particular, when under asymmetric skin pressure one of the short hair cutters 5 is diving, whereas the other one is not diving, the skin contact contour 9 pivots about an axis substantially parallel to the aforementioned pivot axis 8. Said skin contact contour 9 is shown in the figures as a line following the skin contour. The portions of the hair removal tool/cutting units/hair cutter which are in contact with the skin are also understood as the skin contact contour 9. The skin contact surface may include the skin contact contour 9.

As can be seen from FIG. 5, multi-axial pivoting is possible, wherein a second pivot axis 14 may extend substantially perpendicular to the aforementioned first pivot axis 8. Pivoting about such second pivot axis 14 also may be carried out on different levels, i.e. the support structure 11 may allow for pivoting of the working head frame 12 about such second axis 14 and/or the hair removal tools 4 may float and/or dive relative to the working head frame 12 in an asymmetric manner such that the hair removal tools 4 pivot about such second axis 14 relative to the working head frame 12.

Figure 9:
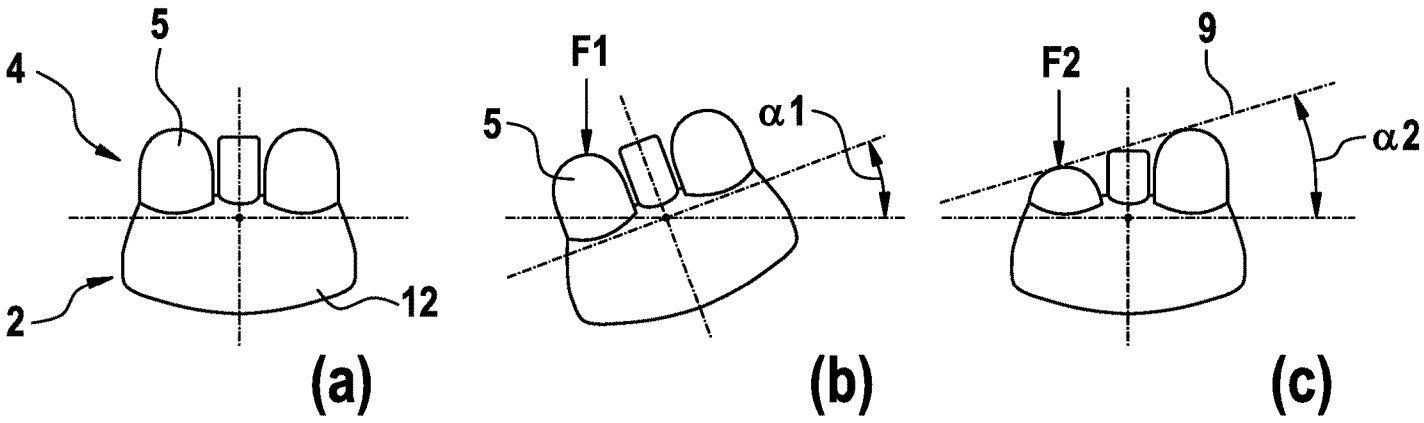
FIG. 9 is a side view of the working head similar to FIGS. 2 to 4, wherein partial view (a) shows the neutral position of the hair removal tools, partial view (b) shows pivoting of the working head frame under a contact force F1 about an angle $\alpha$1, and partial view (c) shows pivoting of the skin contact surface by means of diving of one of the hair removal tools under a contact force F2 about a pivot angle $\alpha$2.
Figure 10:
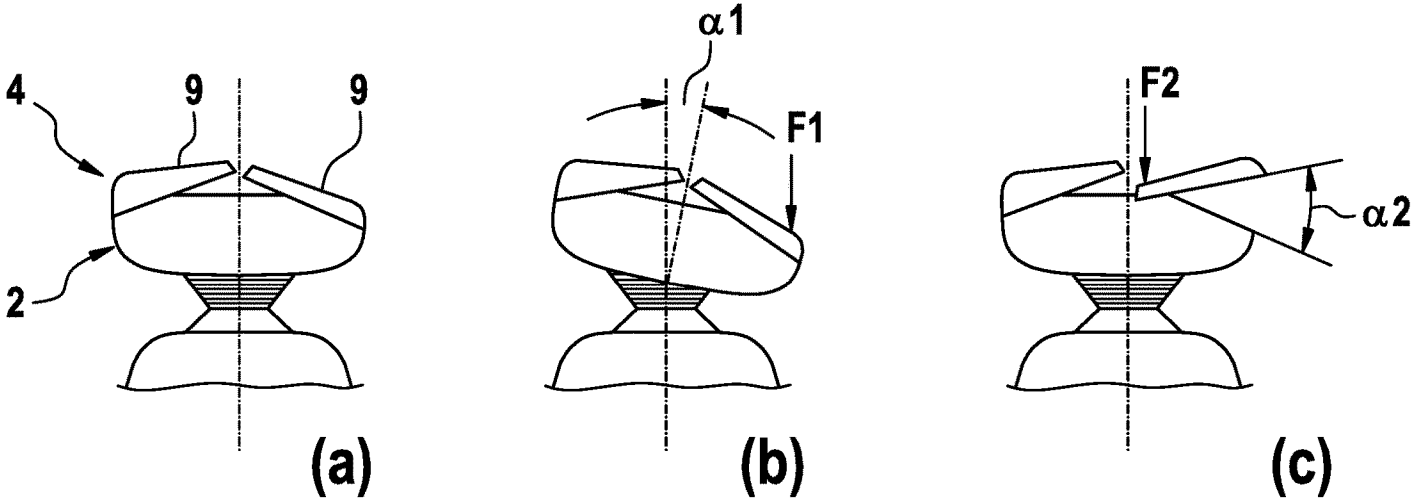
FIG. 10 is a side view of a working head basically similar to FIG. 9 with a working head frame being pivotably supported, wherein, however, different to the example of FIG. 9 the hair removal tools are of a rotary, disk-shaped type allowing for pivoting of the hair removal tools relative to the working head frame.

Due to the multiple degrees of freedom of the working head 2 and the hair removal tools 4 thereof, there may be different pivoting responses to forces applied onto the working head 2 and/or the hair removal tools 4 thereof, as it is illustrated by FIGS. 9 and 10.

As shown by FIG. 9, a skin contact force F1 acting upon one of the outer hair removal tools 4 such as the left short hair cutter 5 may cause pivoting of the working head frame 12 about pivot axis 8. Such pivoting of the working head frame 12 is indicated by pivot angle $\alpha$1.

On the other hand, a skin contact force F2 applied to one of the outer hair removal tools 4 such as the outer short hair cutter 5, also may result in diving and/or floating of the said outer short hair cutter 5, what results in pivoting of the skin contact contour 9 as well. Such pivoting of the skin contact contour 9 due to diving and/or floating of the hair removal tools 4 relative to the working head frame 12 is indicated by pivot angle $\alpha$2, cf.

FIG. 9 (*c*). In the alternative case in which the head frame includes e.g. two portions moveable relative to each other the skin contact contour of each portion of the cutting unit may be not on one line with the other.

Depending on the biasing device 10, more particularly the biasing forces and/or biasing torques applied onto the hair removal tools 4 and/or onto the working head frame 12, a force applied onto one of the hair removal tools 4 may result in pivoting of at least part of the working head frame 12 and/or pivoting of the skin contact contour 9 due to diving of the hair removal tools 4.

Said biasing device 10 may include separate biasing elements 10*a* for biasing the hair removal tools 4 relative to the working head frame 12, wherein such biasing elements 10*a* try to avoid diving and/or floating of the hair removal tools 4 relative to the working head frame 12 and/or urge the hair removal tools 4 into a neutral position in which the tools 4 have a maximum height relative to the working head frame 12. On the other hand, the biasing device 10 may include a biasing element 10*b* for biasing the working head frame 12 into a neutral angular position relative to handle 3, cf. FIG. 8. Additional biasing parts may be provided for biasing parts of the working head frame relative to each other and/or to the handle.

There may be also a biasing device that biases at least parts of the working head frame onto a predetermined position. This fixed or predetermined position is not necessarily the middle position or the position that the head would move based on a gravity alone. Instead this fixed position might e.g. be designed so that the head is in a position where the cutting units can best be seen.

As shown by FIGS. 9 (*b*) and 9 (*c*), the aforementioned forces F1 and F2 may be forces acting onto the outermost hair removal tool 4 which, in a cross-section perpendicular to the pivot axis of interest, has the longest lever arm relative to said pivot axis. Depending on the contour of the hair removal tool, said forces F1 and F2 may act upon such hair removal tool in the middle thereof or at an outer edge portion thereof. For example, when the short hair cutters 5 and 6 are considered, such tool may have a substantially rounded, semi-cylindrical skin contact contour wherein usually a center portion of such barrow-shaped top portion contacts the skin. Consequently, a realistic approach is to assume forces F1 and F2 act upon a center portion of the short hair cutter 5 and 6, cf. FIGS. 9 (*b*) and 9 (*c*).

On the other hand, when the working head 2 includes rotary, basically cup-shaped hair removal tools as shown by FIG. 10, forces F1 and F2, in a realistic approach, may act upon outer and/or inner edge portions of such cup-shaped hair removal tools 4 since forces acting upon such outer and/or inner edge portions of cup-shaped, rotatory cutters have the relevant lever arm causing pivoting.

In any case, i.e. no matter if substantially cylindrical, barrow-shaped cutters as shown in FIG. 9 or cup-shaped cutters as shown in FIG. 10 are used, said forces F1 and F2 may be considered to be applied in a direction substantially perpendicular to the skin contact contour 9 in the neutral position of the working head 2 and the hair removal tools 4. For example, when in a neutral position of the device, said skin contact contour 9 is horizontal as shown by FIG. 2, forces F1 and F2 are applied vertically. The skin contact surface may include the skin contact contour 9.

Determination of said forces F1 and/or F2 may include:

- shaver is turned on with a fully charged battery or plugged into the mains (if product without battery) and if different settings are available, then the setting with the highest head vibration level/highest power level is used. If these levels are different, then the setting with the highest head vibration level is used.

Test conducted under laboratory conditions

- shaver is thoroughly cleaned, e.g. to remove all hair stubble and dirt
- all parts that have a relative movement may be oiled with a droplet of light machine oil (after cleaning, before testing)
- in order to measure F1, it may be necessary to block movement caused by F2, for example via a mechanical fixture that prevents the short hair cutter and/or trimmer tools from diving/moving relative to each other. Likewise in order to measure F2, it may be necessary to block movement caused by F1, for example via a mechanical fixture that prevents the rotation of working head frame about a pivot axis relative to the handle Shaver is fixed in a holder in that way, that the working head with its skin contact contour 9 is aligned horizontally. The applied force is set upright to this arrangement.

The cutters and/or support structure are pressed down onto block. The force and movement is measured with a Mecmesin force and torque test system. The system requires the force value and a displacement value which is based on the angle value.

As already mentioned, applying such force F1 and/or F2 onto the hair removal tools of working head 2 may result in pivot angle α1 and/or pivot angle α2 which, in practice can be superimposed to each other and/or combined with each other. In other words, the skin contact contour 9 defined by an enveloping plane onto the hair removal tools 4 may pivot about an angle α summed up by the partial pivot angles α1 and α2.

Considering the aforementioned kinematics of possible pivot movements and structure of application of forces, the support structure 11 and the biasing device 10 are configured to allow for pivoting of the skin contact contour 9 relative to the handle 3 about an angle α of +/−15° or more under a contact force F of 0.75 N or less and/or about an angle α of +/−25° or more under a contact force of 1.5 N or less.

More particularly, said support structure 11 and said biasing device 10 are configured to allow for pivoting of the skin contact contour 9 relative to the handle 3 about an angle α of +/−22.5° or more under a contact force F of 0.75 N or less and/or about an angle α of +/−30° or more under a contact force of 1.25 N or less.

According to a further aspect, the support structure 11 and the biasing device 10 are configured to allow for pivoting of at least parts of the working head frame 12 about a pivot axis 8 relative to the handle 3 about an angle α1 of +/−20° or more under a contact force F1 and to allow for pivoting of the skin contact contour 9 about a pivot axis parallel to the aforementioned pivot axis 8 by means of moving the hair removal tool (4) relative to the working head frame 12 about an angle α2 of +/−5° or more under a contact force F2, wherein said contact force F1 pivoting the working head frame 12 may be smaller than said contact force F2 moving the hair removal tool 4 relative to the working head frame 12.

More particularly, said contact force F1 pivoting the at least parts of the working head frame 12 is 0.5 N or less and said contact force F2 moving the hair removal tool 4 relative to the working head frame 12 is 1.5 N or less.

Figure 11:
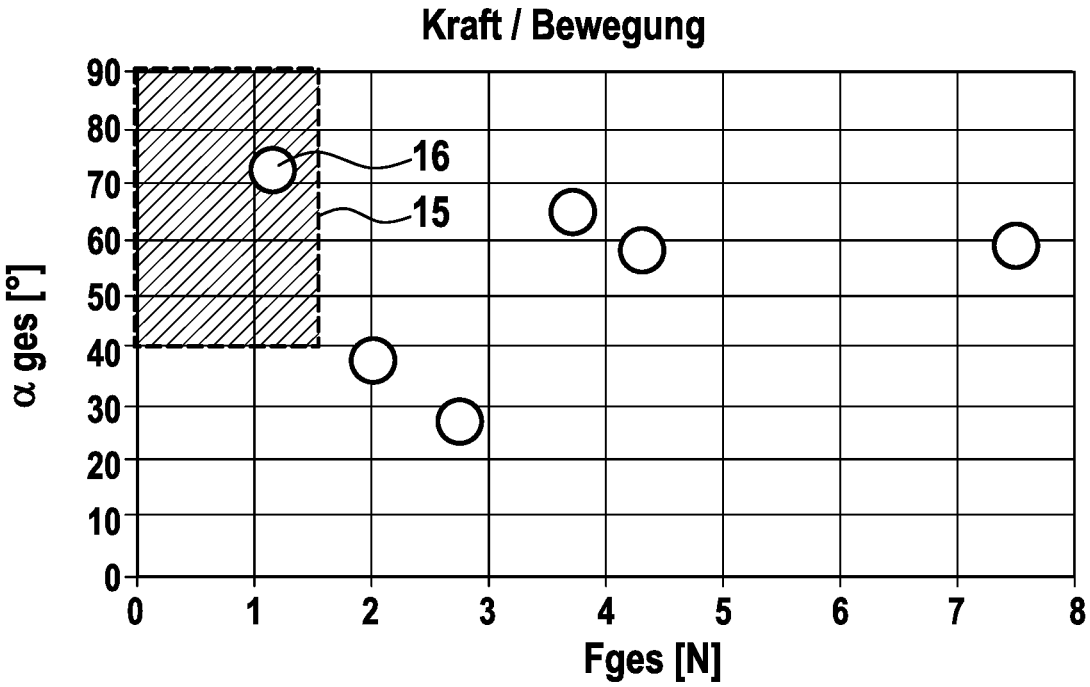
FIG. 11 is a diagram showing the functional relation of the pivot angle achievable under a certain contact force, wherein the dark gray-colored area illustrates the range of pivot angles and contact forces of an advantageous example in comparison to other, less advantageous examples.
Figure 12:
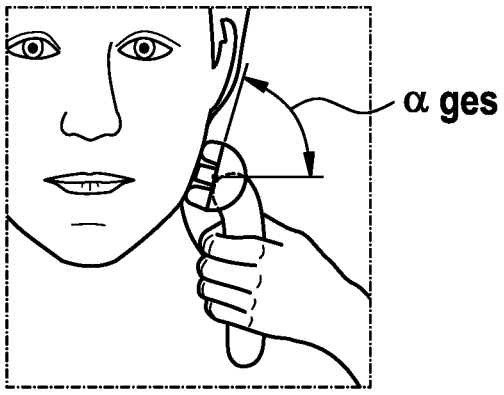
FIG. 12 shows the pivot angle of the working head of the electric shaver of FIGS. 1 to 9 relative to the handle thereof under skin contact forces acting upon the skin contact contour of the working head.

The advantageous range of the available pivot angle and the force F necessary to achieve such pivot angle α is shown by FIG. 11, more particularly the area 15 indicated therein. FIG. 11 is a diagram, wherein one axis shows the skin contact force F in Newton, whereas the other axis shows the pivot angle α.

A particularly advantageous subarea 16 shows pivot angles of about +/−35° to +/−37.5°, i.e. in total of about 70° to 75° under a skin contact pressure F of about 1 N to 1.5 N.

Basically, the support structure 11 including the biasing device 10 may be set up to allow for pivoting of about +/−25° under skin contact forces of 1.5 N or less.

As mentioned, the support structure 11 or biasing device also may include other types of pivot resistance controllers such as a braking device and/or a damper which may be also adjustable in terms of the pivot resistance force and/or pivot resistance torque.

Figure 6:
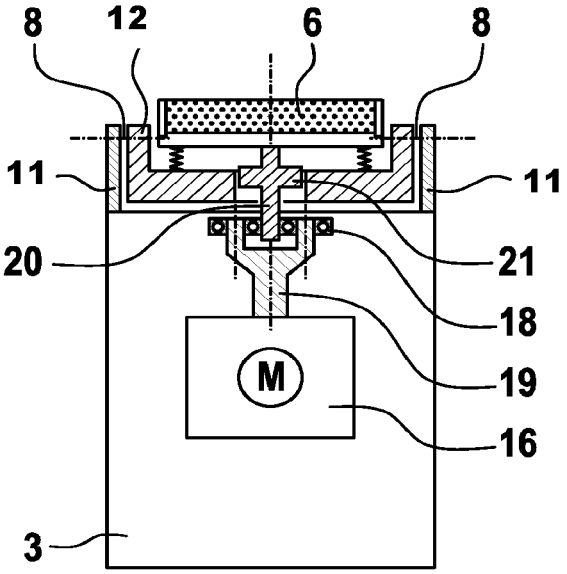
FIG. 6 is a partial cross-sectional front view of the electric shaver similar to FIG. 1, wherein the internal support structure of the working head and the drive train for driving the hair removal tools in a reciprocating manner are shown.

So as to avoid undesired restrictions of the pivoting behavior, the hair removal device may be provided with a drive train avoiding significant frictional forces increasing pivoting resistance. More particularly, as shown by FIGS. 6 and 7, a drive source such as an electric motor 16 may cause a reciprocating movement of the hair removal tools 4 such as the short hair cutters 5 and 6 or the trimmer 7, wherein the drive train 17 connecting the motor 16 to the hair removal tools 4 may include a low-friction bearing 18 which, on the one hand, transmits the driving movement to the hair removal tool 4 and, on the other hand, allows for pivoting of the hair removal tool 4 relative to the motor 16.

For example, said drive train 17 may include an oscillating or reciprocating drive element 19 which may reciprocate in a substantially linear manner in a direction substantially parallel to the cutter movement of the hair removal tool 4. For example, as shown by FIG. 7, said drive element 19 may oscillate substantially perpendicular to the longitudinal axis 31 of handle 3.

Furthermore, said drive train 17 may include a second drive element 20 coupled to the hair removal tool 4 to execute a reciprocating or oscillating movement together with said hair removal tool 4, wherein such drive element 20 may be, e.g., rigidly connected to the drive bridge 21 which in turn is connected in a driving manner to the hair removal tool 4. The aforementioned drive element 20 may have a plate-shaped configuration and/or a bar-shaped configuration with a longitudinal axis substantially perpendicular to the oscillation axis of the other drive element 19.

Figure 7:
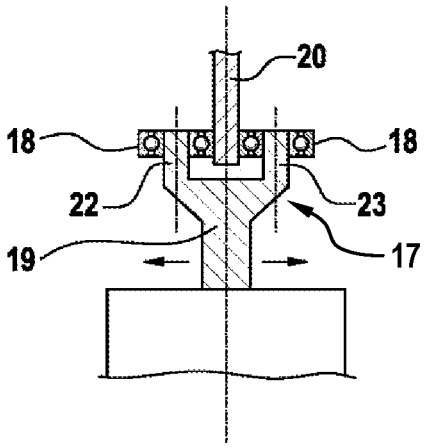
FIG. 7 is an enlarged cross-sectional view of the drive train of FIG. 6 to illustrate the arrangement of a pivotable drive plate between a pair of roller bearings.

As can be seen from FIG. 7, the drive element 20 is coupled to the drive element 19 by means of at least one low-friction bearing 18, wherein drive element 20 may be substantially play-free accommodated between a pair of such low-friction bearings 18 connected to the drive element 19. Such low-friction bearings 18 may include roller bearings, e.g., and/or sliding bearings. For example, the drive element 19 may include a fork portion with two arms spaced away from each other, each arm 22, 23 being provided with one of the low-friction bearings 18 between which the drive element 20 is received. Due to such low-friction bearings 18, the working head frame 12 and/or the hair removal tools 4 may pivot relative to handle 3 substantially without frictional resistance from the drive train 17.

Figure 8:
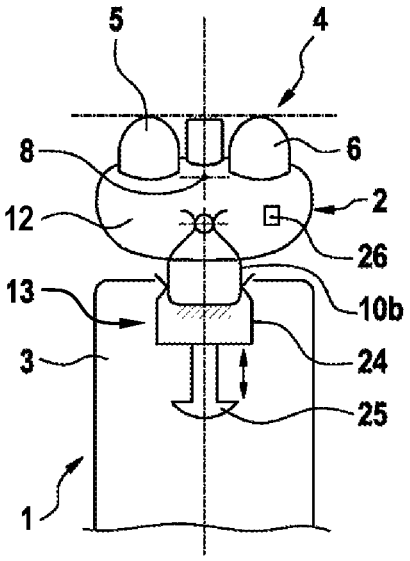
FIG. 8 is a schematic side view of the internal support structure and biasing device for supporting and biasing the working head, wherein an adjustment device for adjusting the angular pivot range and biasing force is shown.

As can be seen from FIG. 8, there may be adjustment of the pivot angle range and/or the biasing force and/or biasing torque. More particularly, a pivot range adjustment device 13 is provided for adjusting the pivot angle α about which the skin contact contour 9 is pivotable relative to the handle 3, to have a first setting in which said angle α is less than +/−35° and more than +/−5° and a second setting in which said angle α is less than +/−25° and more than +/−5° with said second setting different from said first setting.

According to an advantageous aspect, in said first setting the angle α is less than +/−30° and more than +/−20° and in said second setting the angle α is less than +/−20° and more than +/−5°.

According to an advantageous aspect, the pivot range adjustment device 13 is configured to allow for a continuous adjustment of the angle α from at least +/−5° to +/−20° and/or for a stepwise adjustment of the angle α including at least three steps from +/−5° to +/−20° at least.

According to an advantageous aspect, the biasing device 10 is adjustable in terms of biasing force and/or biasing torque by a biasing adjusting device 26 to provide for different biasing forces and/or biasing torques.

According to an advantageous aspect, the pivot range adjustment device 13 is coupled to said biasing adjustment device 26 and configured to increase the biasing force and/or biasing torque of the biasing device 10 when reducing the angle α.

As can be seen from FIG. 8, the pivot range adjustment device 13 may include an adjustment element 24 which may be, e.g., a sleeve cooperating with the biasing element 10*b* of biasing device 10 for biasing the working head frame 12 into its neutral position. An adjustment actuator 25 may be provided so as to move the adjustment element 24 into different positions in which said adjustment element 24 restricts movability of biasing element 10*b* and/or pretensions biasing element 10*b* in different ways and/or onto different levels.

In the above pivoting angles are described as +/− value. This shall mean that the total pivoting range is 2×value, so e.g. a pivoting angle of +/−20° refers to a total pivoting range 2*20° which is 40°. The pivoting angle +/− value may refer to a pivoting of the value in a first and a second direction which is different to the first direction relative to a predefined or neutral position. This +/− value encompasses all options in which the total range is 2*value independent from the starting point and the pivotal movements in one or two directions and e.g. the option that a +/− value of the pivoting angle is implemented from one extreme predefined position of the working head or skin contact contour in just one direction.

The terms hair cutting tools, hair cutting units, individual cutting elements and short hair cutters and trimmers can be exchangeably understood.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm"

What is claimed is:

1. A hair removal device comprising a working head attached to a handle via a support structure for moving the working head along a skin surface, said working head including at least one hair removal tool defining a skin contact contour of the working head, wherein said working head including said at least one hair removal tool is movable relative to said handle under a skin contact pressure by the support structure to allow for pivoting of the working head's skin contact contour relative to the handle, wherein a biasing device is provided for biasing and providing a motion resistance to the working head frame relative to the handle, said biasing device comprising a biasing element mounted to the handle for biasing and providing a motion resistance to the working head frame relative to the handle, wherein a portion of the biasing element is fixedly mounted to the handle so as to be stationary relative to the handle, wherein said support structure and said biasing device are configured to allow for pivoting about a skin contact contour pivot axis of the skin contact contour relative to the handle, wherein a pivot range adjustment device is mounted to the handle and cooperates with the biasing element for adjusting a pivot angle about which the skin contact contour is pivotable relative to the handle.

2. The hair removal device according to claim 1, wherein said support structure, the pivot range adjustment device and said biasing device comprising the biasing element are configured to allow for pivoting about the skin contact contour pivot axis of the skin contact contour relative to the handle about an angle comprising the pivot angle of +/−15° or more under a contact force of 0.75 N or less.

3. The hair removal device according to claim 1, wherein said biasing device is provided for biasing said hair removal tool into a predefined position in the absence of skin contact pressure.

4. The hair removal device according to claim 1, wherein a motor for driving the hair removal tool is accommodated in the handle to reduce inertia of the working head relative to pivoting.

5. The hair removal device according to claim 1, wherein the biasing device comprises a further biasing element, and the further biasing element is configured to allow for pivoting of the skin contact contour about a pivot axis by moving the hair removal tool relative to the working head frame under a contact force.

6. The hair removal device according to claim 1, wherein the biasing device comprises the biasing element, and said working head frame is pivotably supported relative to the handle to allow for pivoting of the skin contact contour relative to the handle about the skin contact contour pivot axis, wherein the support structure and the biasing element are configured to allow for pivoting of the working head frame about a first pivot axis relative to the handle about an angle of +/−20° or more under a contact force.

7. The hair removal device according to claim 6, wherein said contact force for pivoting the working head frame is 0.5 N or less.

8. The hair removal device according to claim 1, wherein the biasing device is adjustable in terms of pivot resistance torque by the pivot range adjustment device to provide for different pivot resistance torques.

9. The hair removal device according to claim 8, wherein the pivot range adjustment device is coupled to said biasing device and configured to increase the pivot resistance torque when reducing the pivot angle about which the skin contact contour may pivot relative to the handle.

10. The hair removal device according to claim 8, wherein an adjustment actuator controlled by an electronic control unit is associated with the pivot range adjustment device and provided for automatically adjusting the pivot angle about which the skin contact contour is pivotable relative to the handle and the pivot resistance torque in response to at least one treatment parameter detected by a detector when handling the hair removal device during a hair removal session.

11. The hair removal device according to claim 10, wherein said detector includes a skin contact pressure sensor providing a signal indicative of skin contact pressure of the working head to said control unit which is configured to control the adjustment actuator in response to such detected skin contact pressure.

12. A hair removal device comprising a working head attached to a handle via a support structure for moving the working head along a skin surface, said working head including at least one hair removal tool defining a skin contact contour of the working head, wherein said working head including said at least one hair removal tool is movable relative to said handle under a skin contact pressure by the support structure to allow for pivoting of the working head's skin contact contour relative to the handle, wherein a biasing element mounted to the handle is provided for biasing and providing a motion resistance to a frame of the working head relative to the handle, wherein a portion of the biasing element is fixedly mounted to the handle so as to be stationary relative to the handle, and a pivot range adjustment device mounted to the handle cooperates with the biasing element for adjusting a pivot angle about which the skin contact contour is pivotable relative to the handle.

13. The hair removal device according to claim 12, wherein in a first setting defined by the pivot range adjustment device, the angle is less than +/−30° and more than +/−20° and in a second setting defined by the pivot range adjustment device, the angle is less than +/−20° and more than +/−2°.

14. A hair removal device comprising a working head attached to a handle via a support structure for moving the working head along a skin surface, said working head including at least one hair removal tool defining a skin contact contour of the working head, wherein said working head including said at least one hair removal tool is movable relative to said handle under a skin contact pressure by the support structure to allow for pivoting of the working head's skin contact contour relative to the handle, wherein a first biasing element is provided for biasing and providing a motion resistance to said hair removal tool relative to a frame of the working head and a second biasing element provides a pivotal motion resistance to the working head frame relative to the handle wherein said support structure and/or said second biasing element are configured to allow for pivoting of the skin contact contour relative to the handle about different angle ranges dependent from the skin contact pressure with which the skin contact contour is applied onto the skin, wherein said second biasing element is mounted to the handle for biasing and providing the motion resistance to the working head frame relative to the handle, wherein a portion of said second biasing element is fixedly mounted to said handle, and a pivot range adjustment device is mounted to the handle and cooperates with the second biasing element for adjusting a pivot angle about which the skin contact contour is pivotable relative to the handle.

15. A hair removal device comprising a working head attached to a handle via a support structure for moving the working head along a skin surface, said working head including at least one hair removal tool defining a skin contact contour of the working head, wherein said working head including said at least one hair removal tool is movable relative to said handle under a skin contact pressure by the support structure to allow for pivoting of the working head's skin contact contour relative to the handle, wherein a biasing device comprising a first biasing element is provided for biasing and providing a motion resistance to said hair removal tool relative to a frame of the working head, said biasing device further comprising a second biasing element mounted to the handle for biasing and providing a motion resistance to the working head frame relative to the handle, wherein a portion of the second biasing element is fixedly mounted to the handle, and wherein a pivot range adjustment device is mounted to the handle and cooperates with the second biasing element for adjusting a pivot angle about which the skin contact contour is pivotable relative to the handle.

* * * * *